US008791394B2

(12) United States Patent
Han et al.

(10) Patent No.: US 8,791,394 B2
(45) Date of Patent: Jul. 29, 2014

(54) HEATING SUBSTRATE EQUIPPED WITH CONDUCTIVE THIN FILM AND ELECTRODE, AND MANUFACTURING METHOD OF THE SAME

(75) Inventors: Chang-Soo Han, Daejeon (KR); Jin-Won Song, Daejeon (KR); Joon-Dong Kim, Daejeon (KR); Yu-Hwan Yoon, Daejeon (KR)

(73) Assignee: Korea Institute of Machinery & Materials, Daejeon (KR)

( * ) Notice: Subject to any disclaimer, the term of this patent is extended or adjusted under 35 U.S.C. 154(b) by 1165 days.

(21) Appl. No.: 12/187,704

(22) Filed: Aug. 7, 2008

(65) Prior Publication Data

US 2009/0057295 A1 Mar. 5, 2009

(30) Foreign Application Priority Data

Aug. 31, 2007 (KR) ..... 10-2007-0088683

(51) Int. Cl.
*H05B 3/02* (2006.01)
*H05B 3/84* (2006.01)
*H01C 1/012* (2006.01)

(52) U.S. Cl.
CPC ..... *H05B 3/84* (2013.01); *H05B 2214/04* (2013.01); *H05B 2203/013* (2013.01)
USPC ..... 219/538; 219/202; 338/308

(58) Field of Classification Search
USPC ..... 219/202, 203, 538, 539, 219, 466.1; 338/308
See application file for complete search history.

(56) References Cited

U.S. PATENT DOCUMENTS 3,721,800 A * 3/1973 Eisler ..... 219/213
4,761,541 A * 8/1988 Batliwalla et al. ..... 219/528
4,952,783 A * 8/1990 Aufderheide et al. ..... 219/528
7,883,609 B2 * 2/2011 Petrenko et al. ..... 204/242
2002/0092849 A1 * 7/2002 Petrenko ..... 219/772
2006/0138123 A1 * 6/2006 Ishii et al. ..... 219/549

FOREIGN PATENT DOCUMENTS

JP 1986-057067 4/1986
JP 05-093903 A 4/1993
JP 05093903 A * 4/1993
JP 07014668 A * 1/1995
JP 10-106726 A 4/1998
JP 11-245772 9/1999
JP 2005-209907 A 8/2005
KR 10-1999-0001077 A 5/1999

OTHER PUBLICATIONS

European Patent Office, The extended European search report of the corresponding application (EP 08014317.5) (Feb. 5, 2013).

* cited by examiner

*Primary Examiner* — Shawntina Fuqua
(74) *Attorney, Agent, or Firm* — Lexyoume IP Meister, PLLC

(57) ABSTRACT

The present invention is to provide a heating substrate equipped with a conductive thin film and electrodes. The heating substrate includes a transparent substrate, a plurality of electrodes formed on a first face of the substrate, and a conductive thin film formed on the first face of the substrate and including a plurality of regions electrically connected each other in parallel by the plurality of electrodes. Furthermore, a method of manufacturing a heating substrate equipped with a conductive thin film and electrodes according to an exemplary embodiment of the present invention includes forming the conductive thin film on a substrate, forming main electrodes so as to extend on the substrate while being adjacent to edges of the conductive thin film, and forming branched electrodes that are extended from the conductive thin film across one side of the conductive thin film while coming in contact with the conductive thin film.

16 Claims, 6 Drawing Sheets

HEATING SUBSTRATE EQUIPPED WITH CONDUCTIVE THIN FILM AND ELECTRODE, AND MANUFACTURING METHOD OF THE SAME

CROSS-REFERENCE TO RELATED APPLICATION

This application claims priority to and the benefit of Korean Patent Application No. 10-2007-0088683 filed in the Korean Intellectual Property Office on Aug. 31, 2007, the entire content of which is incorporated herein by reference.

BACKGROUND OF THE INVENTION (a) Field of the Invention

The present invention relates to a heating substrate equipped with a conductive thin film and electrodes, and a manufacturing method of the same. More particularly, the present invention relates to a heating substrate equipped with a conductive thin film and electrodes and a manufacturing method of the same in which the electrodes are formed at the conductive thin film, and a current flows into the electrodes and the conductive thin film, thereby generating heat.

(b) Description of the Related Art

Generally, heat is generated by applying a current to a transparent conductive thin film, but heating value thereof is restricted by electrical resistance of a conductive thin film. In a heating apparatus that should generate a greater heating value, the limitation of the heating value by the electrical resistance can cause a decisive problem.

As an example, in a case of a heating apparatus that is manufactured by applying a conductive thin film on a polyester (PET) substrate and forming electrodes of a metal component, since the resistance of the conductive thin film is large, there is a limit to the increase of heating value.

In order to obtain a defrosting effect, the heating value should be sufficient to apply the heating apparatus to a broad area such as a front or rear window of an automobile. Particularly, the automobile generally uses a 12V voltage, so there is a limit to the increase of heating value.

Surface resistance of indium tin oxide (ITO), which is a material of a typical conductive thin film, can be changed from several ohms (Ω) to thousands of ohms (Ω) according to manufacturing conditions. However, a lot of costs and a fastidious process are required to lower the surface resistance to several ohms (Ω).

Furthermore, in a case of the thin film formed of carbon nanotubes or a conductive polymer, it is difficult to lower the surface resistance to hundreds of ohms (Ω) or less without impairing transparency as a whole.

Resistance magnitude is not a substantial issue in some application fields, but a great obstacle is occasionally caused in applying to a product to which a low resistance is required. Accordingly, a lot of research into lowering the resistance while maintaining transparency of the conductive thin film is currently being undertaken.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide a heating substrate that is equipped with a conductive thin film and electrodes and has excellent conductivity and heating performance by lowering resistance of the conductive thin film, and a manufacturing method the same.

An exemplary embodiment of the present invention provides a heating substrate equipped with a conductive thin film and electrodes, and the heating substrate includes a transparent substrate, a plurality of electrodes formed on a first face of the substrate, and a conductive thin film formed on the first face of the substrate and including a plurality of regions electrically connected each other in parallel by the plurality of electrodes.

At this time, the phrase that the conductive thin film including the plurality of regions means that the regions are adjacent to each other and are integrally formed to form one conductive thin film, or the regions are divided so as to be disposed at a distance from each other by a physical separation.

In addition, the electrodes may include a first main electrode that is formed so as to extend on the substrate while being adjacent to a first edge of the conductive thin film, a second main electrode that is formed so as to extend on the substrate while being adjacent to a second edge facing the first edge, first branched electrodes that are extended from the first main electrode and extend in the direction of the second main electrode across one side of the conductive thin film while coming in contact with the conductive thin film, and second branched electrodes that are extended from the second main electrode and are formed so as to correspond to the first branched electrodes while coming in contact with the conductive thin film.

In addition, the conductive thin film may be formed in a rectangular form having a uniform thickness, that the first branched electrodes are provided in a plurality, and that the second branched electrodes are formed so as to correspond to the first branched electrodes. Furthermore, the first branched electrodes and the second branched electrodes may be repeatedly formed by turns.

The first branched electrodes and the second branched electrodes may be disposed in parallel with each other. Moreover, a distance between one first branched electrode and a second branched electrode corresponding thereto may be a first width, a distance between another first branched electrode and a second branched electrode corresponding thereto may be a second width, and the second width may be greater than the first width. Visible light transmissivity of a second region having the second width may be larger than that of a first region having the first width.

In addition, the conductive thin film may include a first conductive thin film and a second conductive thin film that are formed with at regular gap therebetween, a first branched electrode may be formed so as to be adjacent to one edge of the first conductive thin film and the second conductive thin film, a second branched electrode may be formed so as to be adjacent to the other edge of the first conductive thin film and the second conductive thin film, and the first main electrode and the second main electrode may be connected to each other in parallel.

In addition, the first conductive thin film and the second conductive thin film may have the same form, and the conductive thin film may have visible light transmissivity in the range of 10% to 99.9%. Furthermore, the conductive thin film may be made of at least one component selected from indium tin oxide (ITO), ZnO, $SnO_2$, $In_2O_3$, $CdSnO_4$, a carbon-based material including carbon nanotubes, fluorine-doped tin oxide (FTO), and aluminum-doped zinc oxide (AZO).

In addition, the main electrodes and the branched electrodes may be formed such that surface resistance thereof is low compared with the conductive thin film, and the main electrodes and the branched electrodes may be made of a metal including Al, Au, Ag, or Cu. Moreover, at least one of the main electrodes and the branched electrodes may be formed of a transparent conductive material.

Furthermore, a transparent dielectric layer may be formed on the substrate, and the transparent dielectric layer may cover the conductive thin film, the branched electrodes, and the main electrodes.

Another embodiment of the present invention provides a method of manufacturing a heating substrate equipped with a conductive thin film and electrodes. The method includes forming the conductive thin film on a substrate; forming main electrodes to extend on the substrate while being adjacent to edges of the conductive thin film, and forming branched electrodes that are extended from the conductive thin film across one side of the conductive thin film while coming in contact with the conductive thin film.

DETAILED DESCRIPTION OF THE EMBODIMENTS

Figure 1A:
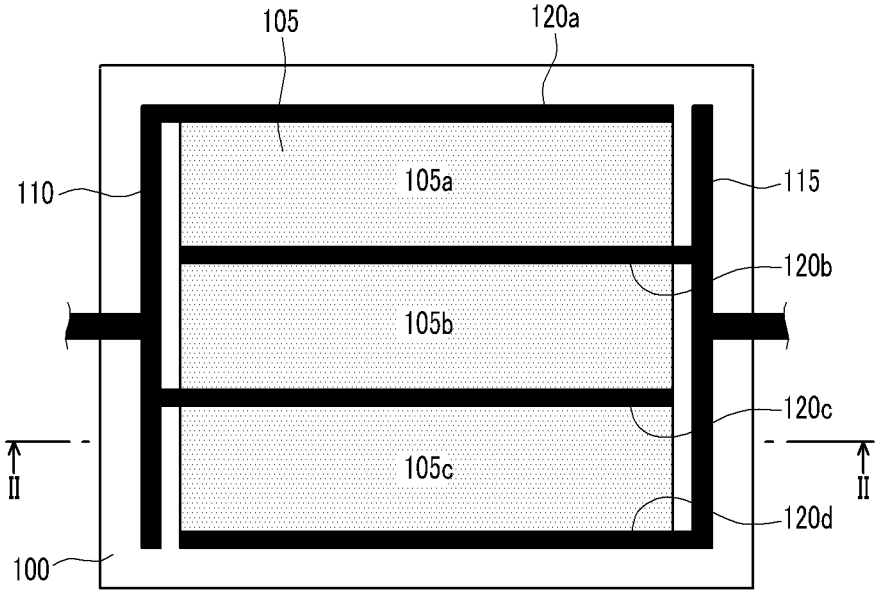
FIG. 1A is a top plan view of a heating substrate equipped with a conductive thin film and electrodes according to a first exemplary embodiment of the present invention.

The present invention will be described more fully hereinafter with reference to the accompanying drawings, in which exemplary embodiments of the invention are shown. As those skilled in the art would realize, the described embodiments may be modified in various different ways, all without departing from the spirit or scope of the present invention.

The drawings and description are to be regarded as illustrative in nature and not restrictive. Like reference numerals designate like elements throughout the specification.

A heating substrate equipped with a conductive thin film and electrodes according to an exemplary embodiment of the present invention will be described more fully hereinafter with reference to the accompanying drawings.

FIG. 1A is a top plan view of a heating substrate equipped with a conductive thin film and electrodes according to a first exemplary embodiment of the present invention.

Referring to FIG. 1A, the heating substrate equipped with the conductive thin film and the electrodes according to the present exemplary embodiment includes a transparent substrate 100, a conductive thin film 105 that is thinly formed on the transparent substrate 100, main electrodes 110 and 115 that are adjacently formed along both edges of the conductive thin film 105, and branched electrodes 120*a*, 120*b*, 120*c*, and 120*d* that are formed so as to be extended from the main electrodes 110 and 115, respectively.

According to the present exemplary embodiment, the conductive thin film 105 is formed on the substrate 100 in a rectangular form. In addition, as shown in FIG. 1A, the first main electrode 110 is formed so as to be adjacent to a left edge of the conductive thin film 105, and the second main electrode 115 is formed so as to be adjacent to a right edge of the conductive thin film 105.

Furthermore, the branched electrodes include the first branched electrode 120*a*, the second branched electrode 120*b*, the third branched electrode 120*c*, and the fourth branched electrode 120*d*. The first branched electrode 120*a* and the third branched electrode 120*c* are extended from the first main electrode 110 and toward the second main electrode 115, thereby being formed on the conductive thin film 105. Moreover, the second branched electrode 120*b* and the fourth branched electrode 120*d* are extended from the second main electrode 115 toward the first main electrode 110, thereby being formed on the conductive thin film 105.

As shown in FIG. 1A, the branched electrodes 120*a*, 120*b*, 120*c*, and 120*d* are disposed in parallel to each other, and the branched electrodes 120*a* and 120*c* extended from the first main electrode 110 and the branched electrodes 120*b* and 120*d* extended from the second main electrode 115 are alternately disposed.

According to the present exemplary embodiment, a current flows from the first main electrode 110 to the second main electrode 115 through the branched electrodes 120*a*, 120*b*, 120*c*, and 120*d*. In detail, the current flows from the first main electrode 110 to the second branched electrode 120*b* and from the second main electrode 115 through the first branched electrode 120*a* and an upper part 105*a* of the conductive thin film 105.

In the same manner, the current flows from the first main electrode 110 to the second branched electrode 120*b* and the second main electrode 115 through the third branched electrode 120*c* and a middle part 105*b* of the conductive thin film 105, and the current flows from the first main electrode 110 to the fourth branched electrode 120*d* and the second main electrode 115 through the third branched electrode 120*c* and a lower part 105*c* of the conductive thin film 105.

Figure 1B:
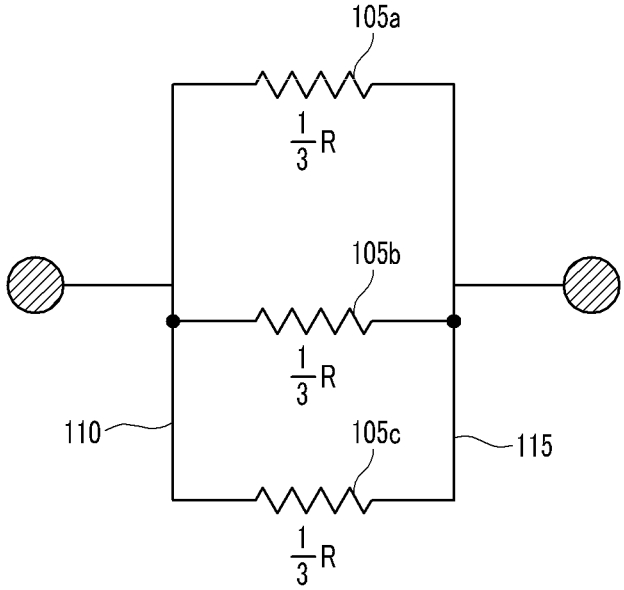
FIG. 1B is a circuit diagram schematically illustrating the structure of FIG. 1A.

FIG. 1B is a circuit diagram illustrating schematically a structure of FIG. 1A. At this time, on the supposition that resistance of the branched electrode is much smaller than that of the conductive thin film, the resistance of the branched electrode is disregarded in this calculation.

The structure of FIG. 1A can be expressed by the circuit diagram shown in FIG. 1B. This circuit diagram will now be described more fully. When the branched electrodes 120*b* and 120*c* passing through the middle part are not present, supposing that electrical resistance of all conductive thin films 105*a*, 105*b*, and 105*c* is R, the resistance of each conductive thin film 105*a*, 105*b*, and 105*c* is merely R/3. Therefore, according to the circuit diagram shown in FIG. 1B, electrical resistance R' between the main electrodes 110 and 115 is merely about R/9 (see following Expression 1).

$$\frac{1}{R'} = \frac{1}{\frac{1}{3}R} + \frac{1}{\frac{1}{3}R} + \frac{1}{\frac{1}{3}R} \quad \text{[Expression 1]}$$

Since each width of the three conductive thin films 105*a*, 105*b*, and 105*c* is reduced by the branched electrodes 120*a*, 120*b*, 120*c*, and 120*d*, the electrical resistance of each conductive thin film is reduced to ⅓. Moreover, since these conductive thin films are connected in parallel, the electrical resistance is further reduced to ⅙. Theoretically, in a case of dividing the conductive thin films, the resistance is reduced in proportion to the square.

In the present exemplary embodiment, when voltage V is constant, if resistance R decreases, current intensity I increases. As described above, when the current intensity I increases, electric energy P is increased (see following Expression 2).

$$V = I \times R,$$

$$P = I \times V \quad \text{[Expression 2]}$$

In the present exemplary embodiment, in a case of increasing the number of branched electrodes 120*a*, 120*b*, 120*c*, and 120*d*, the resistance between the main electrodes 110 and 115 further reduces. Nevertheless, since the branched electrodes 120*a*, 120*b*, 120*c*, and 120*d* are made of materials for example of Ag and Cu that have good conductivity and are opaque, visible light transmissivity of a heating apparatus according to the present exemplary embodiment is reduced. Like a defrosting apparatus for a window of an automobile, a metal wire can be directly used as a material of the electrodes 110, 115, 120*a*, 120*b*, 120*c*, and 120*d*.

However, the present invention is not limited thereto, and the main electrodes 110 and 115 and/or the branched electrodes 120*a*, 120*b*, 120*c*, and 120*d* may be made of a transparent conductive material. These transparent conductive materials may include various materials such as indium tin oxide (ITO), fluorine-doped tin oxide (FTO), and aluminum-doped zinc oxide (AZO). When the main electrodes 110 and 115 and/or the branched electrodes 120*a*, 120*b*, 120*c*, and 120*d* are made of the transparent conductive materials, it is possible to enhance the visible light transmissivity. In the following exemplary embodiment as well as the present exemplary embodiment, the main electrodes and/or the branched electrodes are made of the transparent conductive materials.

Figure 2:
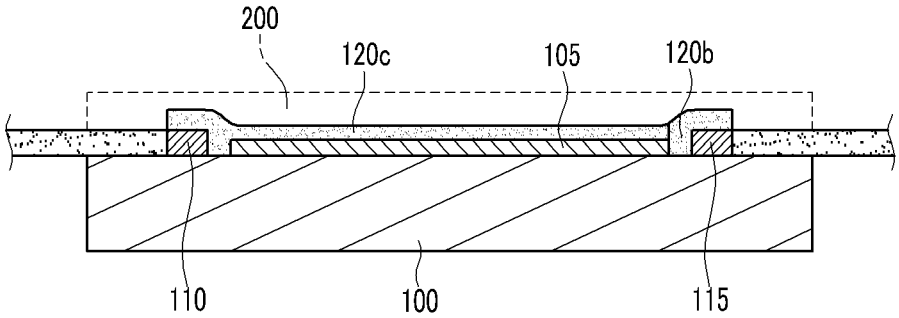
FIG. 2 is a cross-sectional view of the heating substrate equipped with the conductive thin film and the electrodes taken along line II-II of FIG. 1A.

FIG. 2 is a cross-sectional view of the heating substrate equipped with the conductive thin film and the electrodes taken along line II-II of FIG. 1A.

As shown in FIG. 2, the conductive thin film 105, the main electrodes 110 and 115, and the branched electrodes 120*a*, 120*b*, 120*c*, and 120*d* are formed on the substrate 100. Furthermore, a dielectric layer 200 or an insulating layer (not shown) may be further formed on the substrate 100, and the dielectric layer 200 covers the conductive thin film 105, the main electrodes 110 and 115, and the branched electrodes 120*a*, 120*b*, 120*c*, and 120*d*, thereby protecting them from moisture or foreign substances.

According to the present exemplary embodiment, it is preferable that the conductive thin film 105 is formed to a thickness of 100 μm or less, but there are no special limitations in the thickness thereof. In addition, it is preferable that the visible light transmissivity of the conductive thin film 105 is in the range of 10% to 99.9%. Moreover, it is preferable that surface resistance of the conductive thin film 105 is in the range of 0.1Ω/□ to $10^{12}$Ω/□.

The transparent conductive thin film 105 can be made of various materials. An example of popular materials is indium tin oxide (ITO). Particularly, as an example, conductive polymers and carbon-based materials including carbon nanotubes can be used in the exemplary embodiment of the present invention.

In addition to the above materials, various materials such as ZnO, $SnO_2$, $In_2O_3$, and $CdSnO_4$ can be utilized. It is possible to manufacture a thin film that improves the conductivity by partially containing functional materials such as fluorine or metals (e.g., Au, Al, and Ag).

For example, fluorine-doped tin oxide (FTO) and aluminum-doped zinc oxide (AZO) can be applicable for the thin film.

An organic conductive polymer can also be used for the transparent conductive thin film. Since the 1970s, organic conductive polymers have been developed. Due to such development efforts, conductive materials based on polymer types such as polyaniline, a polythiophene, polypyrrole, and polyacetylene have been developed.

According to the present exemplary embodiment, the conductive thin film can be manufactured by using carbon-based materials (for example carbon nanotubes and carbon black). Here, the carbon nanotubes include single-walled carbon nanotubes, multi-walled carbon nanotubes, and carbon nanotubes to which various materials (metals or polymers) are added so as to improve conductivity.

Nevertheless, all materials that are capable of manufacturing the thin film and being used as the thin film can be utilized for the conductive thin film. The transparent conductive thin film according to the present exemplary embodiment can be utilized for a field emission display, electrostatic shielding, a touch screen, an electrode for LCD, a heater, a functional optical film, a composite material, a chemical and bio sensor, a solar cell, an energy-storage substance, an electronic element, or the like.

Particularly, the polymer or the carbon nanotubes can be effectively used as a material of a flexible display or a flexible solar cell in which a flexible and transparent conductive thin film is necessary.

Figure 3:
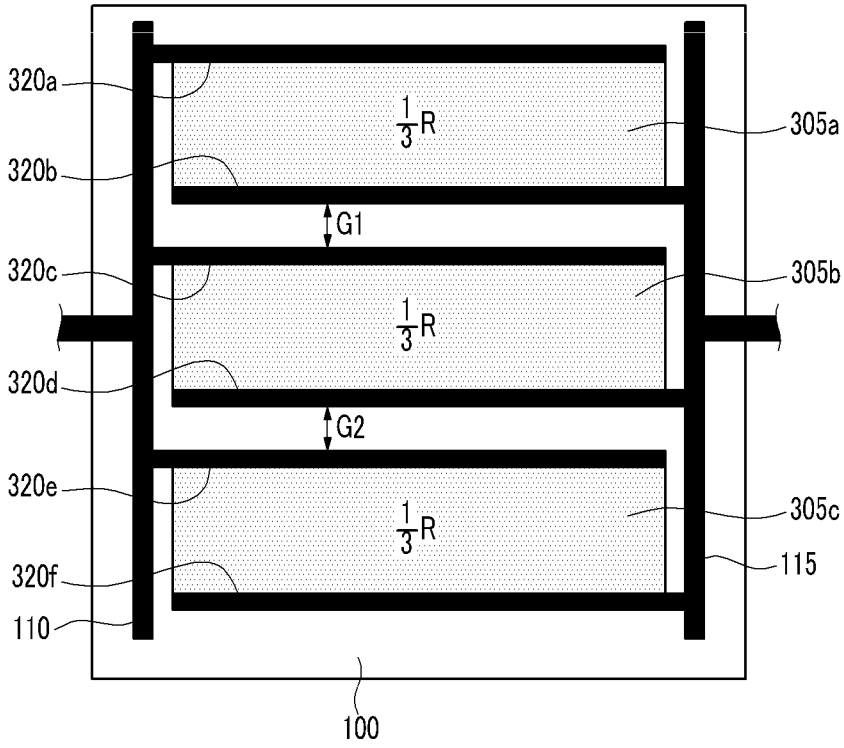
FIG. 3 is a top plan view of a heating substrate equipped with a conductive thin film and electrodes according to a second exemplary embodiment of the present invention.

FIG. 3 is a top plan view of a heating substrate equipped with a conductive thin film and electrodes according to a second exemplary embodiment of the present invention.

Referring to FIG. 3, a conductive thin film includes a first conductive thin film 305*a*, a second conductive thin film 305*b*, and a third conductive thin film 305*c*. According to the present exemplary embodiment, the conductive thin films 305*a*, 305*b*, and 305*c* are formed on the substrate in the same form of a rectangle.

In addition, the first conductive thin film 305*a* and the second conductive thin film 305*b* have a first gap G1 therebetween, and the second conductive thin film 305*b* and the third conductive thin film 305*c* have a second gap G2 therebetween. The conductive thin films 305*a*, 305*b*, and 305*c* are physically spaced from each other and electrically insulated from each other. The above-described configuration is distinguished from the first exemplary embodiment of the present invention described with reference to FIG. 1A. In the present exemplary embodiment, the first gap G1 and the second gap G2 have the same size.

A first branched electrode 320*a* is formed from the first main electrode 110 along an upper edge of the first conductive thin film 305*a*, and a second branched electrode 320*b* is formed from the second main electrode 115 along a lower edge of the first conductive thin film 305*a*.

In the same manner, a third branched electrode 320*c* is formed from the first main electrode 110 along an upper edge of the second conductive thin film 305*b*, and a fourth branched electrode 320*d* is formed from the second main electrode 115 along a lower edge of the second conductive thin film 305*b*. Moreover, a fifth branched electrode 320*e* is formed from the first main electrode 110 along an upper edge of the third conductive thin film 305*c*, and a sixth branched electrode 320*f* is formed from the second main electrode 115 along a lower edge of the third conductive thin film 305*c*.

Figure 4A:
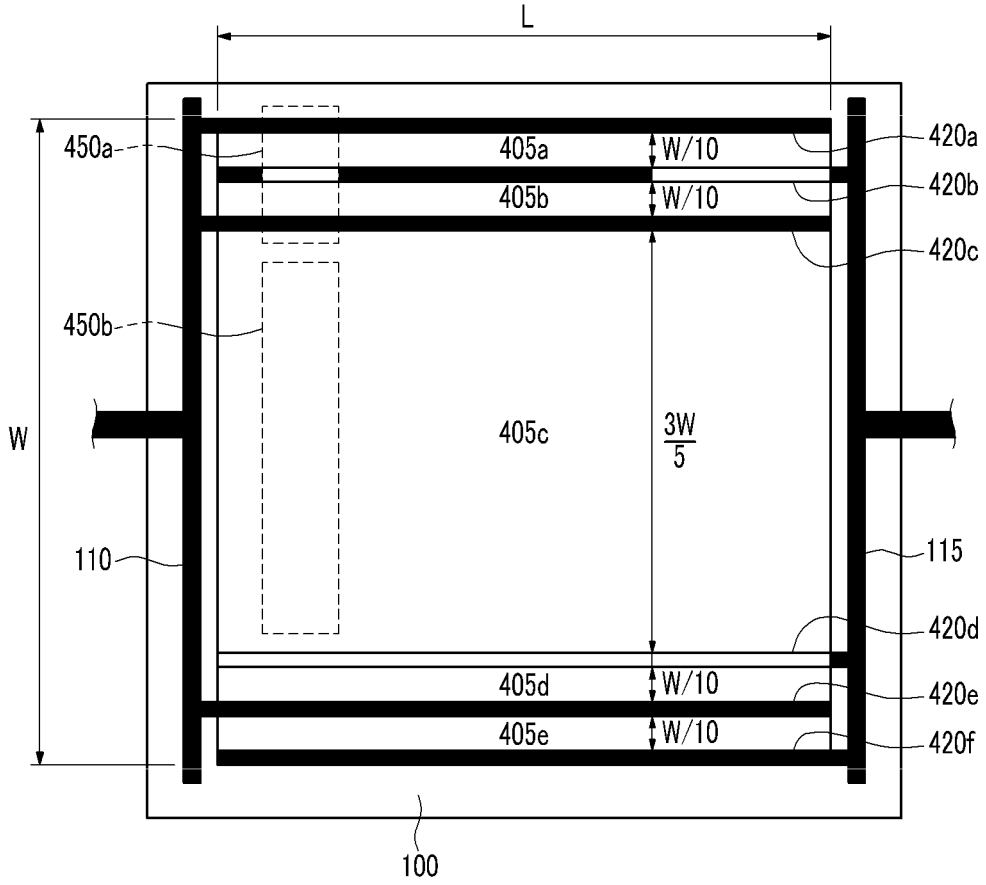
FIG. 4A is a top plan view of a heating substrate equipped with a conductive thin film and electrodes according to a third exemplary embodiment of the present invention.

FIG. 4A is a top plan view of a heating substrate equipped with a conductive thin film and electrodes according to a third exemplary embodiment of the present invention.

Referring to FIG. 4A, the heating substrate equipped with the conductive thin film and the electrodes according to the present exemplary embodiment includes a transparent substrate 100, a conductive thin film 405 that is thinly formed on the transparent substrate 100, main electrodes 110 and 115 that are formed along both edges of the conductive thin film 405, and branched electrodes 420 that are formed so as to be extended from the main electrodes 110 and 115, respectively.

The branched electrode includes a first branched electrode 420*a*, a second branched electrode 420*b*, a third branched electrode 420*c*, a fourth branched electrode 420*d*, a fifth branched electrode 420*e*, and a sixth branched electrode 420*f*. Furthermore, the first branched electrode 420*a*, the third branched electrode 420*c*, and the fifth branched electrode 420*e* are extended from the first main electrode 110 toward the second main electrode 115, thereby being formed on the conductive thin film 405. Moreover, the second branched electrode 420*b*, the fourth branched electrode 420*d*, and the sixth branched electrode 420*e* are extended from the second main electrode 115 toward the first main electrode 110, thereby being formed on the conductive thin film 405.

As shown in FIG. 4A, the branched electrodes 420*a*, 420*b*, 420*c*, 420*d*, 420*e*, and 420*f* are disposed in parallel to each other, and the branched electrodes 420*a*, 420*c*, and 420*e* extended from the first main electrode 110 and the branched electrodes 420*b*, 420*d*, and 420*f* extended from the second main electrode 115 are alternately disposed.

According to the present exemplary embodiment, a current flows from the first main electrode 110 to the second main electrode 115 through the branched electrodes 420 and the conductive thin film 405.

The heating substrate according to the present exemplary embodiment has a rectangular form where the breadth of the conductive thin film has a first length L, and where the height thereof has a first width W. In addition, the main electrodes 110 and 115 are formed in the height direction along both edges of the conductive thin film 405, and the lengths of the main electrodes 110 and 115 are longer than the first width W of the conductive thin film 405.

In addition, the current flows from the first main electrode 110 to the second branched electrode 420*b* and the second main electrode 115 through the first branched electrode 420*a* and a first part 405*a* of the conductive thin film 405, and the current flows from the first main electrode 110 to the second branched electrode 420*b* and the second main electrode 115 through the third branched electrode 420*c* and a second part 405*b* of the conductive thin film 405.

As shown in FIG. 4A, in the present exemplary embodiment, the distance between the first branched electrode 420*a* and the second branched electrode 420*b* is W/10, and the distance between the second branched electrode 420*b* and the third branched electrode 420*c* is also W/10. In addition, the distance between the third branched electrode 420*c* and the fourth branched electrode 420*d* is 3W/5, the distance between the fourth branched electrode 420*d* and the fifth branched electrode 420*e* is W/10, and the distance between the fifth branched electrode 420*e* and the sixth branched electrode 420*f* is also W/10.

Referring to FIG. 4A once again, the conductive thin film 405 according to the present exemplary embodiment has a first region 450*a* and a second region 450*b*. The first region 450*a* has a short length within the branched electrodes 420*a*, 420*b*, and 420*c*, and the second region 450*b* has a relatively long length between the branched electrodes 420*c* and 420*d*. The first region 450*a* has low visible light transmissivity due to the branched electrodes 420*a*, 420*b*, and 420*c* that are opaque, and the second region 450*b* has relatively high visible light transmissivity.

That is, in the structure of FIG. 4A, the second region 450*b* of a middle part has good visibility (visible light transmissivity), and the first regions 450*a* of edge parts have degraded visibility. This structure is applicable to an apparatus having good visibility and high heating performance.

Figure 4B:
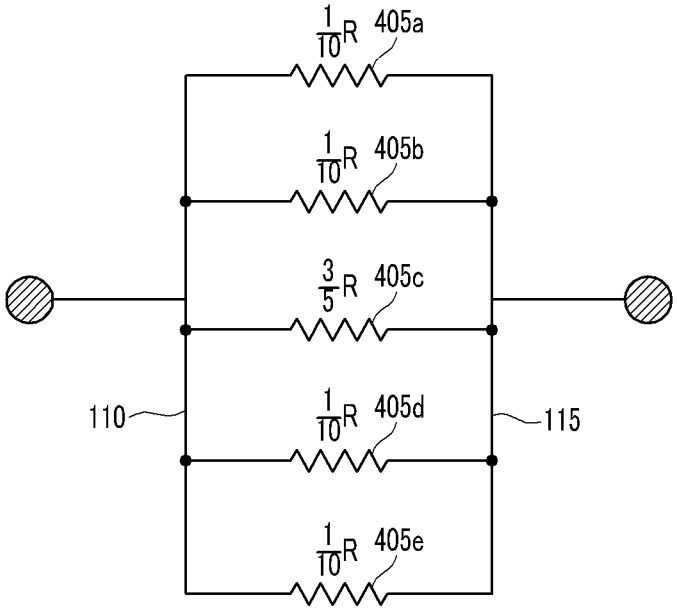
FIG. 4B is a circuit diagram schematically illustrating the structure of FIG. 4A.

FIG. 4B is a circuit diagram schematically illustrating the structure of FIG. 4A.

The structure of FIG. 4A can be expressed by the circuit diagram shown in FIG. 4B. This circuit diagram will now be described more fully. When parts of the branched electrodes 420*b*, 420*c*, 420*d*, and 420*e* are not present, the electrical resistance of all conductive thin films 405 is R. At this time, when the branched electrodes 420*b*, 420*c*, 420*d*, and 420*e* are formed as in the present exemplary embodiment, electrical resistance R" between the main electrodes 110 and 115 is merely about R/42 (see following Expression 3).

$$\frac{1}{R''} = \frac{1}{\frac{1}{10}R} + \frac{1}{\frac{1}{10}R} + \frac{1}{\frac{3}{5}R} + \frac{1}{\frac{1}{10}R} + \frac{1}{\frac{1}{10}R} \qquad \text{[Expression 3]}$$

When the distance between each of the branched electrodes 420*a*, 420*b*, 420*c*, 420*d*, 420*e*, and 420*f* is W/5, respectively, the resistance between the main electrodes 110 and 115 is approximately R/25.

Figure 5:
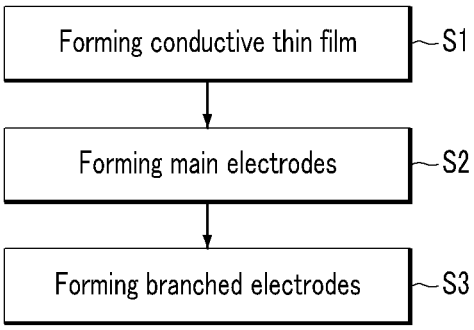
FIG. 5 is a flowchart illustrating the manufacturing procedure of a heating substrate equipped with a conductive thin film and electrodes according to an exemplary embodiment of the present invention.

FIG. 5 is a flowchart illustrating the manufacturing procedure of a heating substrate equipped with a conductive thin film and electrodes according to an exemplary embodiment of the present invention.

Referring to FIG. 1A and FIG. 5, a method of manufacturing the heating substrate using the conductive thin film and the electrodes according to the present exemplary embodiment includes forming the conductive thin film 105 on the transparent substrate 100 (S1), forming the main electrodes 110 and 115 so as to be adjacent to the conductive thin film 105 (S2), and forming the branched electrodes 120 on the conductive thin film 105 so as extend from the main electrodes 110 and 115 (S3).

Although the forming of the conductive thin film (S1), the forming of the main electrodes (S2), and the forming of the branched electrodes (S3) are sequentially illustrated in FIG. 5, this order can be changed. For example, the method of manufacturing the heating substrate using the conductive thin film and the electrodes according to the present exemplary embodiment may be accompanied by steps of S1→S3→S2, S2→S3→S1, S2→S1→S3, S3→S1→S2, and S2→S3→S1.

Figure 6A:
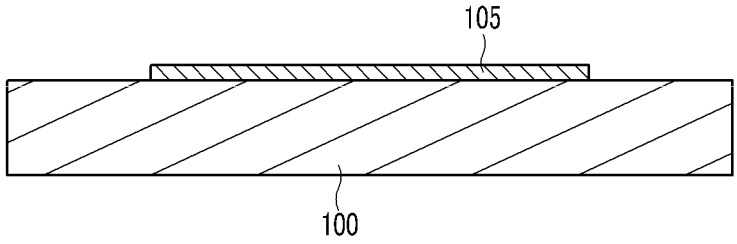
FIG. 6A to FIG. 6C are views illustrating the manufacturing process of a heating apparatus using a conductive thin film and electrodes according to an exemplary embodiment of the present invention.
Figure 6B:
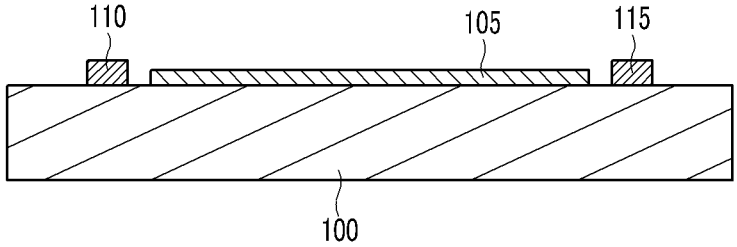
Figure 6C:
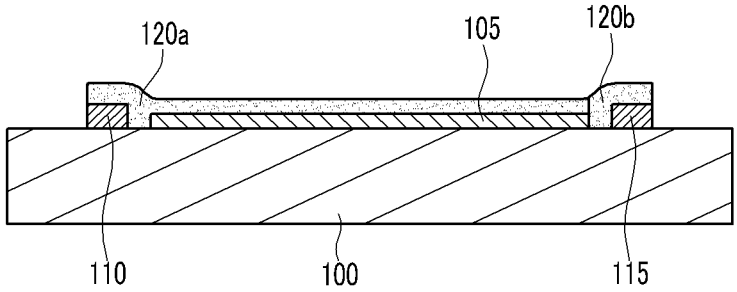

FIG. 6A to FIG. 6C are views illustrating the manufacturing process of a heating apparatus using a conductive thin film and electrodes according to an exemplary embodiment of the present invention.

As shown in FIG. 6A, the conductive thin film 105 is formed on the transparent substrate 100 by thinly applying the conductive thin film. Next, as shown in FIG. 6B, the main electrodes 110 and 115 are formed so as to be adjacent to the conductive thin film 105. Then, as shown in FIG. 6C, the branched electrodes 120*a* and 120*b* are formed along the conductive thin film 105 from the main electrodes 110 and 115.

FIG. 6A to FIG. 6C are illustrated with reference to the flowchart exemplarily disclosed in FIG. 5. Naturally, the manufacturing process may be changed according to the steps of S1→S3→S2, S2→S3→S1, S2→S1→S3, S3→S1→S2, and S2→S3→S1 in FIG. 5. In addition, the steps S2 and S3 may be simultaneously performed with the same material.

First, the conductive thin film 105 may be formed of materials such as indium tin oxide, carbon nanotubes, and a conductive polymer on the transparent substrate 100 by various techniques including sputtering, spin coating, gravure printing, spray coating, slit coating, and dip coating.

Particularly, almost all opaque metal materials may be also used as the material of fine electrodes 110, 115, 120*a*, and 120*b*. In view of transparency, various transparent conductive materials including existing indium tin oxide (ITO) may be used.

The method of forming the electrodes 110, 115, 120*a*, and 120*b* includes inkjet printing, screen printing, gravure printing, and optical lithography. The electrodes 110, 115, 120*a*, and 120*b* may be formed by suitably selecting the methods according to the thickness and width of the electrodes. Particularly, the branched electrodes can be manufactured by a process of attaching a metal wire.

According to the heating substrate equipped with the conductive thin film and the electrodes of the present invention, the conductive thin film is formed between the main electrodes formed on the substrate, the branched electrodes are formed at the conductive thin film, and this conductive thin film is electrically connected in parallel. Therefore, the electrical resistance of the conductive thin films is reduced between the main electrodes. As a result, the current flows more through the conductive thin film, and the heating value of the conductive thin films is improved.

In addition, in the heating apparatus equipped with the conductive thin film and the electrodes according to the present invention, the conductive thin film is divided into several parts, and the branched electrodes are formed at the divided conductive thin films, respectively. Accordingly, since the current flows more easily through the conductive thin film, the heating performance of the conductive thin film is further improved.

Furthermore, in the heating apparatus equipped with the conductive thin film and the electrodes according to the present invention, since the widths between the branched electrodes formed at the conductive thin film are regular, the current flowing through the conductive thin film is uniformly distributed. Accordingly, the entire conductive thin film can exhibit a uniform heating performance.

Moreover, in the heating apparatus equipped with the conductive thin film and the electrodes according to the present invention, the widths between the branched electrodes formed at the conductive thin film are different from each other. Here, a broader width is applied to a portion of high visibility (visible light transmissivity), and a narrower width can be applied to a portion in which the visibility is not high.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A heating substrate equipped with a conductive thin film and electrodes, comprising:

a transparent substrate;

a plurality of electrodes formed on a first face of the substrate; and a conductive thin film formed on the first face of the substrate electrically connected to the plurality of electrodes, wherein the electrodes comprise:

a first main electrode that extends along the substrate adjacent to a first edge of the conductive thin film;

a second main electrode that extends along the substrate adjacent to a second edge of the conductive thin film facing the first edge;

first branched electrodes that extend from the first main electrode and are formed so as to extend in the direction of the second main electrode across one side of the conductive thin film while contacting with the conductive thin film; and second branched electrodes that extend from the second main electrode and are formed to face with the first branched electrodes while contacting with the conductive thin film, wherein the first main electrode is spaced apart from the conductive thin film with a gap therebetween and the second main electrode is spaced apart from the conductive thin film with another gap therebetween such that the first main electrode and the second electrode are not in direct contact with the conductive thin film.

2. The heating substrate of claim 1, wherein the conductive thin film has a rectangular form and uniform thickness.

3. The heating substrate of claim 1, wherein the first branched electrodes are provided in a plurality, and the second branched electrodes are formed to face with the first branched electrodes.

4. The heating substrate of claim 3, wherein the first branched electrodes and the second branched electrodes are formed by turns.

5. The heating substrate of claim 3, wherein the first branched electrodes and the second branched electrodes are disposed in parallel with each other.

6. The heating substrate of claim 3, wherein:

a distance between one first branched electrode and a second branched electrode corresponding thereto is a first width;

a distance between another first branched electrode and a second branched electrode corresponding thereto is a second width; and the second width is greater than the first width.

7. The heating substrate of claim 6, wherein visible light transmissivity of a second region having the second width is larger than that of a first region having the first width.

8. The heating substrate of claim 1, wherein:

the conductive thin film includes a first conductive thin film and a second conductive thin film that are formed with a regular gap therebetween;

a first branched electrode is formed so as to be adjacent to one edge of the first conductive thin film and the second conductive thin film;

a second branched electrode is formed so as to be adjacent to the other edge of the first conductive thin film and the second conductive thin film; and the first main electrode and the second main electrode are connected to each other in parallel.

9. The heating substrate of claim 8, wherein the first conductive thin film and the second conductive thin film have the same shape.

10. The heating substrate of claim 1, wherein the conductive thin film has visible light transmissivity in the range of 10% to 99.9%.

11. The heating substrate of claim 1, wherein the conductive thin film comprises at least one component selected from indium tin oxide (ITO), ZnO, $SnO_2$, $In_2O_3$, $CdSnO_4$, a carbon-based material including carbon nanotubes, fluorine-doped tin oxide (FTO), and aluminum-doped zinc oxide (AZO).

12. The heating substrate of claim 1, wherein the main electrodes and the branched electrodes are formed such that surface resistance thereof is lower than surface resistance of the conductive thin film.

13. The heating substrate of claim 12, wherein the main electrodes and the branched electrodes comprise a metal including Al, Au, Ag, or Cu.

14. The heating substrate of claim 1, wherein at least one of the main electrodes and the branched electrodes comprise a transparent conductive material.

15. The heating substrate of claim 1, wherein:

a transparent dielectric layer is formed on the substrate; and the transparent dielectric layer covers the conductive thin film and the electrodes.

16. A method of manufacturing a heating substrate equipped with a conductive thin film and electrodes, comprising:

forming the conductive thin film on a substrate;

forming main electrodes that extend along the substrate while being spaced apart from edges of the conductive thin film with a gap therebetween such that the main electrodes are not in direct contact with the conductive thin film; and forming branched electrodes, which extend from the conductive thin film, across one side of the conductive thin film while contacting with the conductive thin film.

* * * * *